US005403688A

United States Patent [19]

Ashiya et al.

[11] Patent Number: 5,403,688

[45] Date of Patent: Apr. 4, 1995

[54] METHOD FOR DETERMINING TERMINATION TIME OF THE STEP OF DISPERSING A COATING COMPOSITION FOR PHOTOSENSITIVE LAYER OF ELECTROPHOTOGRAPHIC PHOTORECEPTOR AND ELECTROPHOTOGRAPHIC PHOTORECEPTOR PREPARED USING THE DISPERSION

[75] Inventors: Seiji Ashiya; Taketoshi Hoshizaki; Ryosaku Igarashi; Koji Bando; Masanori Murase; Takahiro Suzuki; Masahiko Hodumi; Sadao Okano, all of Kanagawa, Japan

[73] Assignee: Fuji Xerox Co., Ltd., Tokyo, Japan

[21] Appl. No.: 646,312

[22] Filed: Jan. 28, 1991

[30] Foreign Application Priority Data

Jan. 29, 1990 [JP] Japan ..... 2-15999

[51] Int. Cl.[6] ..... G03G 15/08

[52] U.S. Cl. ..... 430/84; 427/9; 427/10; 430/58; 430/127

[58] Field of Search ..... 430/84, 127, 58; 427/9, 427/10

[56] References Cited

U.S. PATENT DOCUMENTS

| | | | |
|---|---|---|---|
| 4,356,246 | 10/1982 | Tabei et al. | 430/136 |
| 4,908,410 | 3/1990 | Malhotra | 525/276 |
| 4,974,964 | 12/1990 | Yoshihara et al. | 366/152 |
| 4,980,254 | 12/1990 | Hiro | 430/58 |

*Primary Examiner*—Marion E. McCamish
*Attorney, Agent, or Firm*—Finnegan, Henderson, Farabow, Garrett & Dunner

[57] ABSTRACT

A method for determining a termination time of the step of dispersing a coating composition for a photosensitive layer, containing a binder resin, a powdery charge generating material and a solvent, is disclosed, which comprises (i) providing coating (I) on a substrate by coating the coating composition, following by drying, (ii) providing coating (II) on a substrate by dispersing the coating composition using a dispersion medium to fine the powdery charge generating material, followed by drying, (iii) measuring absorbances of coating (I) at two wavelengths within a short wavelength region and a long wavelength region, respectively, of the spectral absorption wavelength of the charge generating material, (iv) measuring absorbances of coating (II) at the two wavelengthes within the short wavelength region and the long wavelength region, respectively, and (v) calculating spectral absorbance ratios of coatings (I) and (II), respectively, from the following equation:

$$\text{Spectral absorbance ratio} = \frac{\text{Absorbance at a wave length with the short wavelength region}}{\text{Absorbance at a wavelength within the long wavelength region}}$$

wherein the dispersing of the coating composition is terminated when the ratio of the spectral absorbance ratio of coating (II) to that of coating (I) exceed a predetermined value.

9 Claims, 1 Drawing Sheet

METHOD FOR DETERMINING TERMINATION TIME OF THE STEP OF DISPERSING A COATING COMPOSITION FOR PHOTOSENSITIVE LAYER OF ELECTROPHOTOGRAPHIC PHOTORECEPTOR AND ELECTROPHOTOGRAPHIC PHOTORECEPTOR PREPARED USING THE DISPERSION

FIELD OF THE INVENTION

This invention relates to a method of for determining a termination time of the step of dispersing a coating composition for a photosensitive layer of electrophotographic photoreceptors and an electrophotographic photoreceptor using the thus obtained dispersion.

BACKGROUND OF THE INVENTION

An electrophotographic photoreceptor which has been practically used at present is generally classified into an inorganic photoreceptor using an inorganic photosensitive material and an organic photoreceptor using an organic photosensitive material.

As typical inorganic photosensitive materials, there are selenium photosensitive materials composed of amorphous selenium (a-Se), amorphous arsenic selenide (a-$As_2Se_2$), etc., a photosensitive material composed of dye-sensitized zinc oxide (ZnO) or cadmium sulfide (CdS) dispersed in a binder resin; and a photosensitive material using amorphous silicon (a-Si).

However, the aforesaid inorganic photoreceptor using selenium series materials or CdS suffers problems in the heat resistance and the storage stability. Also, since these materials have a toxicity, there is a restriction that they cannot be simply wasted and must be recovered.

The ZnO-resin dispersion type photoreceptor has been scarcely used at present since it has a low sensitivity and a low durability.

Also, although the a-Si type photoreceptor has merits such as high sensitivity, high durability, etc., it has disadvantages that the production cost is high because of complexity in the production process thereof and image defects occur due by film defect specific to a-Si.

On the other hand, typical organic photoreceptors include those using a charge transferring complex of 2,4,7-trinitro-9-fluorenone (TNF) and poly-N-vinylcarbazole (PVK), and those of function separation type having a charge generating layer and a charge transport layer. Since there are many kinds of organic photosensitive materials for these organic photoreceptors, those free from the problems on the storage stability and toxicity can be produced by properly selecting the organic photosensitive materials, and besides they can be produced at a low cost. Further, durability thereof has been recently improved. Thus, the organic photosensitive materials are given attention as one of the most important photosensitive materials.

However, the organic photoreceptors using the aforesaid PVK-TNF charge transfer complex are still insufficient in sensitivity.

The aforesaid function separation type organic photoreceptors have a double layer structure of a layer containing a charge generating material capable of generating charge carriers upon irradiation with light (hereinafter, referred to as a charge generating layer) and a layer containing a material capable of receiving the charge carriers generated in the charge generating layer and transferring them (hereinafter, referred to as a charge transport layer), have a relatively excellent sensitivity, and are the main current of organic photoreceptors which are practically used at present.

When the charge generating material does not have a film-forming property by itself, it is used along with a binder resin, whereby the film is formed.

When a photosensitive layer is formed on a drum or a film by a coating method, the following properties are required:

(1) good electric characteristics, (2) a good dispersibility such that the components are not aggregated for improving the stability of the coating composition with the passage of time, (3) a uniformity of the coated surface for preventing the occurrence of roughening of the image quality, and (4) a good adhesion for imparting the mechanical durability as a photosensitive material.

However, when the aforesaid conventional electrophotographic photoreceptor having a photosensitive layer formed by dispersing a charge generating material in a binder resin is produced by a coating methods, the electrophotographic photoreceptor does not satisfy all the properties (1) to (4) and hence is not sufficient in electrophotographic characteristics.

Also, it is known that the dispersibility of a charge generating material in a photosensitive layer gives a large influence on the aforesaid properties (1) to (4) and hence it has hitherto been attempted to control the dispersibility of a charge generating material in a photosensitive layer. Hitherto, a termination time of the step of dispersing a charge generating material in a binder resin has been determined by monitoring the dispersion state of the charge generating material in a coating composition for a photosensitive layer using a centrifugal sedimentation type particle size distribution meter, a laser scattering type spectrophotometer, etc. as described in JP-A-63-136055 (the term "JP-A" means an unexamined published Japanese patent application), but the dispersion state monitored by the above conventional method does not exhibit good correlation with the electrophotographic characteristics of the resulting photosensitive layer and hence the conventional method is not a satisfactory method for determining a termination time of the step of dispersing a charge generating material.

SUMMARY OF THE INVENTION

An object of this invention is to provide a method for determining a termination time of the step of dispersing a charge generating material in a binder resin in preparation of a coating composition for a photosensitive layer of electrophotographic photoreceptors, wherein the monitored dispersion state of the charge generating material has good correlation with the electrophotographic characteristics of the resulting photosensitive layer.

Another object of this invention is to provide an electrophotographic photoreceptor having high sensitivity and high stability in repeated use by effectively utilizing excellent characteristics specific to a charge generating material.

Still another object of this invention is to provide an electrophotographic photoreceptor having an improved dispersibility of a charge generating material in the photosensitive layer and a good coated surface property, and not giving roughened image quality.

As the results of various investigations on finding a method of monitoring the dispersion state of a charge generating material in a photosensitive layer, which reflects the electrophotographic characteristics of the photosensitive layer in good correlation, the inventors have discovered that it is effective to monitor a ratio of absorbances at specific wavelengthes of a coating of a coating composition for forming a photosensitive layer.

Also, as the results of further investigations on a photosensitive layer composed of a charge generating material dispersed in a binder resin, the inventors have further discovered that the aforesaid objects can be achieved by setting the absorbance ratio of a coating of a coating composition for the photosensitive layer to a specific range.

That is, according to this invention, there is provided a method for determining a termination time of the step of dispersing a coating composition for a photosensitive layer, containing a binder resin, a powdery charge generating material and a solvent, which comprises:

(i) providing coating (I) on a substrate by coating the coating composition, following by drying, (ii) providing coating (II) on a substrate by dispersing the coating composition using a dispersion medium to fine the powdery charge generating material, followed by drying, (iii) measuring absorbances of coating (I) at two wavelengthes within a short wavelength region and a long wavelength region, respectively, of the spectral absorption wavelength of the charge generating material, (iv) measuring absorbances of coating (II) at the two wavelengthes within the short wavelength region and the long wavelength region, respectively, and (v) calculating spectral absorbance ratios of coatings (I) and (II), respectively, from the following equation:

$$\text{Spectral absorbance ratio} = \frac{\text{Absorbance at a wave length with the short wavelength region}}{\text{Absorbance at a wavelength within the long wavelength region}}$$

wherein said dispersing of the coating composition is terminated when the ratio of the spectral absorbance ratio of coating (II) to that of coating (I) exceeds a predetermined value.

DETAILED DESCRIPTION OF THE INVENTION

Figure 1:
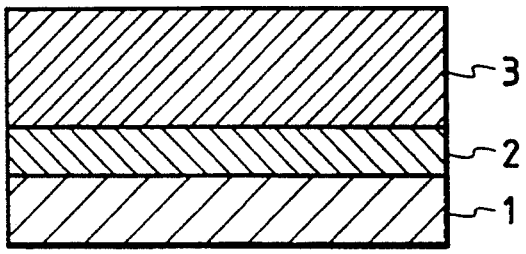
FIGS. 1 to 4 each is a sectional view of an electrophotographic photoreceptor of this invention.

In this invention, any photosensitive layers containing therein a charge generating material can be used as the photosensitive layer being measured by the method of this invention. For example, the photosensitive layer may be a single layer type photosensitive layer obtained by coating a coating composition composed of a charge generating material, a binder resin and a solvent on an electrically conductive base plate, followed by drying (in this case, the solvent is removed by drying), or may be a photosensitive layer further containing therein a charge transport material in a dispersed state of the molecule in addition to the aforesaid components. Also, the binder resin itself in the photosensitive layer may have a photoconductivity or a charge transport property.

Furthermore, the photosensitive layer may have a construction function-separated into a charge generating layer and a charge transport layer, and in this case, since the charge generating layer is composed of a binder resin and a charge generating material, the method of this invention is applied to the charge generating layer.

The method of this invention can be applied to any panchromatic charge generating materials showing a light absorption or a light sensitivity in at least the whole visible light region. Practically, the invention is applicable to charge generating materials having a light absorption (light sensitivity) in the wavelength region of from about 400 n.m. to about 750 n.m. Furthermore, this invention is applicable to charge generating materials having a light sensitivity in not only visible light region but also the infrared region of a semiconductor laser light source (about 780 n.m.), etc. Practical examples of the charge generating material are trigonal system selenium, bisazo pigments, condensed polycyclic pigments, and phthalocyanine pigments.

In this invention, a coating composition for a photosensitive layer, which contains a binder resin, a charge generating material and a solvent, is uniformly mixed and coated on a transparent substrate before and after the coating composition is dispersed with a dispersion medium, whereby coating (I) and coating (II) are formed, respectively, and absorbances at the specific wavelengthes of coatings (I) and (II) are measured.

In measuring the spectral absorbances of a charge generating material at a short wavelength region and a long wavelength region of the spectral absorption wavelength of the charge generating material with respect to coatings (I) and (II), one wavelength in the short wavelength region and one wavelength in the long wavelength region shall be properly selected according to the form of the absorption spectrum of the charge generating material. In general, it is better to select one wavelength from the short wavelength region of from about 400 to 550 n.m. and to select one wavelength from the long wavelength region of from about 650 to 750 n.m., and it is preferred that the former wavelength is set within the range of 500 n.m.±30 n.m. and the latter wavelength is set within the range of 700 n.m.±30 n.m. Practically, when trigonal system selenium is used, it is most preferred that the wavelength in the short wavelength region is set at 500 n.m. and the wavelength in the long wavelength region is set at 700 n.m.

The reason why the dispersion state of a charge generating material in the dispersing step can be properly monitored by the method of this invention is as follows. While spectral absorbances of the coatings vary depending on inherent absorption and particle size of materials contained therein, the coating composition for a photosensitive layer of electrophotographic photoreceptors contains much more fine particles of the charge generating material having a particle size of less than 1.0 μm after the dispersing step than that before the dispersing step. That is, in the dispersing step of the coating composition, the charge generating material is generally fined with the passage of the dispersion time whereby light of long wavelength is liable to transmit therethrough and thus the light absorption in a long wavelength region is reduced, while even when the charge generating material is fined, the change of the light absorption at a short wavelength region is less, although the extent may differ depending upon the kind of the dispersion medium, the rotation number, the ratio of dispersing media (e.g., balls in a ball mill) to the charge generating material, and the kind of the solvent and the binder resin.

Since the spectral absorbance ratio of the coating after the dispersing step (i.e., coating (II)) becomes relatively larger than that before the dispersing step (i.e., coating (I)) with the passage of the dispersing time, by measuring the ratio of the former to the latter and determining the correspondence of the correlation with the electrophotographic characteristics, the dispersion state of the charge generating material in the photosensitive layer capable of giving the optimum electrophotographic characteristics can be indirectly determined in terms of the ratio of the spectral absorbance ratios.

The ratio of the spectral absorbance ratio of coating (II) to the spectral absorbance ratio of coating (I) giving good electrophotographic characteristics generally depends upon the charge generating material used, but it is generally from 2.0 to 6.0, and preferably from 2.0 to 3.0. When trigonal system selenium is used as the charge generating material, the range of the aforesaid ratio of from 2.5 to 3.0 gives the best result.

In mass production of electrophotographic photoreceptors, a coating composition for a photosensitive latter thereof is sampled during the dispersing step and the ratio of the spectral absorbance ratios are measured according to the method of this invention. By checking the ratio with the predetermined ratio giving good electrophotographic characteristics, the termination time of the dispersing step is determined. Since the predetermined ratio has been determined based on measurement of the actually coated layer as in the photoreceptors, the monitored dispersion state exhibits excellent correlation with electrophotographic characteristics of the resulting products.

The term "dispersing step: used herein means the step of uniformly dispersing particles of a charge generating material in a solvent solution of a binder resin by application of mechanical strain force thereby to fine the particles. The mechanical strain force can be applied using a dispersion medium such as a ball mill, an attritor, a sand mill, a homomixer, a colloid mill, a roll mill, a pearl mill, a jaw mill, and the like.

In the method of the present invention, the spectral absorbances of coatings (I) and (II) are measured in the same conditions. Only difference is in that the coating composition for coating (II) has been treated by the dispersing step. The measurement is carried out in the following manner. First, a coating composition containing a binder resin, a powdery charge generating material and a solvent is uniformly mixed, preferably by application of supersonic wave thereto, and coated on a light-transmitting substrate such as a glass plate, followed by drying to remove the solvent, whereby coating (I) is formed. The binder resin may previously be dissolved in a solvent to which the charge generating material is added with or without an additional solvent. The thickness of the coating is not particularly limited, but it is preferably from 0.1 to 5.0 μm, more preferably from 0.5 to 2.0 μm, since the S/N can be increased. Coating (II) is prepared in the same manner except that the coating composition is treated by the dispersion step. Then, the coatings are mounted on a commercially available transmission type spectrophotometer to measure absorbances at the predetermined wavelengthes as described above. Since it is the spectral absorbance ratio of each coating that is calculated, the thicknesses of the two coatings need not be the same. As described above, however, they are preferably the same in order to increase the S/N.

It is preferred that the coating composition for coatings (I) and (II) contains 0.5 to 10 wt. % of a binder resin, 1 to 40 wt. % of a powdery charge generating material and 50 to 99 wt. % of a solvent. The coating composition may also contain other additives such as a charge transport material.

The method of the present invention is effectively applied when the powdery charge generating material used as a staring material has a particle size of from 0.5 to 500 μm and preferably form 1 to 50 μm. In general, organic pigments as a charge generating material have a particle size within the above range since they are synthesized in the form of pigment paste which is heated to dry and suppled in the form of coarse particles.

Then, preparation of electrophotographic photoreceptors utilizing the method of this invention is explained in detail below.

That is, as another embodiment of this invention, there is provided an electrophotographic photoreceptor having on an electrically conductive support a photosensitive layer formed by coating a coating composition which contains a binder resin, trigonal system selenium and a solvent and which has been dispersed with a dispersion medium, wherein the spectral absorbance ratio given by the following equation of the coated layer is at least twice the spectral absorbance ratio of a coated layer of the coating composition which is not subjected to the dispersing treatment;

$$\text{Spectral absorbance ratio} = \frac{\text{Absorbance at 500 n.m.}}{\text{Absorbance at 700 n.m.}}$$

The photosensitive layer of the electrophotographic photoreceptor of this embodiment may be a single layer structure but has preferably a double layer structure functionally separated into a charge generating layer and a charge transport layer.

FIGS. 1 to 4 are schematic sectional views of this case.

In FIG. 1, a charge generating layer 2 and a charge transport layer 3 are successively formed on a conductive support 1.

Figure 2:
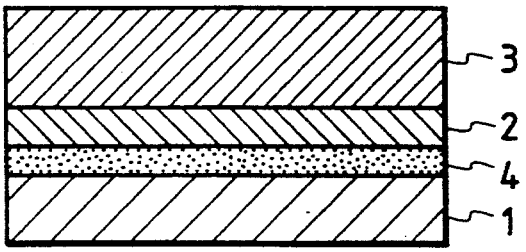

In FIG. 2, a subbing layer 4 is formed between the conductive support 1 and the charge generating layer 2 in FIG. 1.

Figure 3:
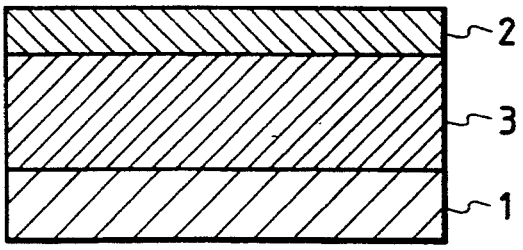

In FIG. 3, a charge transport layer 3 and a charge generating layer 2 are successively formed on a conductive support 1.

Figure 4:
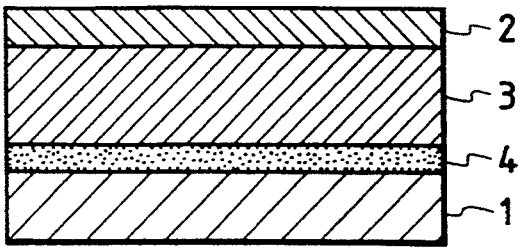

In FIG. 4, a subbing layer 4 is formed between the conductive support 1 and the charge transport layer 3 in FIG. 3.

In the electrophotographic photoreceptor of this embodiment, any electrically conductive supports which are conventionally used for electrophotographic photoreceptors can used, and the support may be any form, for example, a plate form, a pipe form, a flexible sheet form, etc.

The charge generating layer contains a binder resin and from 10 to 90% by volume, preferably from 30 to 70% by volume, of a powdery charge generating material as the main components. As the charge generating material, trigonal system selenium is used in this embodiment.

As the binder resin, conventionally used resins such as polystyrene resins, silicone resins, polycarbonate resins, acrylic resins, methacrylic resins, polyester resins, vinylic resins, cellulose resins, alkyd resins, etc., can be used.

The charge generating material, i.e., trigonal system selenium is dispersed together with the binder resin in a solvent by means of a ball mill, an attritor, a sand mill, a homomixer, a colloid mill, a roll mill, etc. as a dispersion medium, such that the mixture becomes the dispersion state as defined above.

Examples of the solvent being used for the coating composition are ketones such as cyclohexanone, methyl ethyl ketone, etc.; alcohols such as methanol, ethanol, butanol, etc.; amides such as N,N-dimethylformamide, etc.; ethers such as tetrahydrofuran, dioxane, ethylene glycol monobutyl ether, etc.; halogenated hydrocarbons such as chloroform, methylene chloride, dichloroethylene, carbon tetrachloride, trichloroethylene, etc.; and aromatic hydrocarbons such as benzene, toluene, xylene, monochlorobenzene, dichlorobenzene, etc.

The dispersion state is evaluated by forming a coated layer on a transparent substrate using the aforesaid dispersion and then measuring the absorbances at the wavelengthes of 500 n.m. and 700 n.m. of the coated layer using a transmission type spectrophotometer.

In the dispersing step of the coating composition, the charge generating material contained therein becomes finer with the progress of the dispersion treatment. When coated the coating composition, this phenomenon is physically observed as if the long wavelength component of the spectral absorbance is increased. By fining of the charge generating material, the coated layer becomes reddish and the absorbance ($d_{700}$) at the wavelength of 700 n.m. is reduced.

Hitherto, for measuring the dispersion state of a charge generating material, a centrifugal sedimentation type particle distribution meter, a laser scattering type spectrophotometer, etc., is used. Although such a measuring device is useful for the evaluation of the dispersion state, the particle distribution, etc., of a dispersion, the device is insufficient for the evaluation of the dispersion state of a charge generating material in the case of practical coated layer.

The spectral absorbance ratio in the present invention is useful for defining the dispersion state of a charge generating material in a coated layer in a practical electrophotographic photosensitive material. In this embodiment, it is necessary that the spectral absorbance ratio of the coated layer of the coating composition after the dispersion treatment is at least twice the spectral absorbance ratio of that before the dispersion treatment.

If the value is less than twice, there occur disadvantages that the electrophotographic characteristics are deteriorated (such as the increase of dark decay, raising of the residual potential, etc.), the coating composition is lacking in the stability with the passage of time and is liable to be aggregated, and the coated layer formed is ununiform to cause many coating defects. The aforesaid value can be increased over twice by prolonging the dispersing time, the selection of the dispersion medium, the selection of the rotation number and the ratio of dispersing media to the charge generating material, and the selection of the kinds of the solvent and the binder resin.

For forming the charge generating layer, the dispersion obtained as described above is used as the coating composition and the coating composition may be coated by a dip coating method, spray coating method, a plate coating method, a spinner coating method, a bead coating method, a curtain coating method, etc.

After coating, the coated layer is dried at a temperature range of from 10° to 150° C., and preferably from 20° to 100° C. for from 5 minutes to 5 hours, preferably from 10 minutes to 2 hours by air blow drying or static drying.

The thickness of the charge generating layer is generally selected in the range of from 0.05 to 5 μm.

The charge transport layer of the electrophotographic photoreceptor of this embodiment is formed by coating a coating composition prepared by dissolving a charge transport material in a solvent together with a binder resin.

Examples of the charge transport material are a compound represented by formula (I)

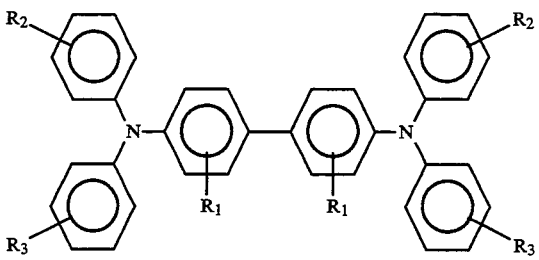

(I)

(wherein $R_1$ and $R_2$ each represents H, $CH_3$ or $C_2H_5$ and $R_3$ represents H, $CH_3$, $C_2H_5$, or Cl), hydrazone series compounds and pyrazoline series compounds.

In this embodiment, as the charge transfer material, the compounds shown by above formula (I), in particular, N,N'-diphenyl-N,N'-bis(3-methylphenyl)-[1,1'-bisphenyl]-4,4'-diamine is preferred in the point of excellent sensitivity.

Since the above charge transport material does not have a film-forming property by itself, it is necessary to form the charge transport layer using a resin having a good film-forming property. In this embodiment, as such a resin, polycarbonate is particularly suitable in view of the mechanical strength of the resulting layer.

Details of polycarbonate are described in *Plastic Material Course 5 Polycarbonate Resin*, published by Nikkan Kogyo Shinbun Sha in 1969, and polycarbonate resins having various properties are known according to the kinds of raw material monomers. For example, polycarbonate A which is poly(4,4'-isopropilidene-diphenylene carbonate most largely produced, and a compound having repeating unit shown by the following formula (II) and having a weight average molecular weight 10,000 to 200,000 are advantageously used in this embodiment.

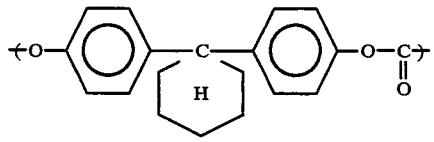

(II)

The content of the charge transport material in the charge transport layer is from 10 to 75% by weight, and preferably from 35 to 60% by weight.

If the content of the charge transport material is larger than the aforesaid range, the mechanical strength of the charge transport layer is reduced, while the content thereof is less than the aforesaid range, the sensitivity of the electrophotographic photoreceptor is lowered.

The thickness of the charge transport layer is usually in the range of from 5 to 50 μm.

While the photosensitive layer having a double layer structure, was explained above, the photosensitive layer of a single layer structure can be similarly formed using the charge generating material, a charge transport material, a binder resin, and a solvent.

In this embodiment, it is preferred that a subbing layer is formed between the conductive support and the photosensitive layer.

By properly selecting materials for the subbing layer, the action as a charge injection inhibiting layer or the adhesion between the conductive support and the photosensitive layer can be improved.

The thickness of the subbing layer is preferably from about 0.001 to 5 μm. As the material which is used for the layer, there are polyvinyl acetal, polyamide, polyvinyl alcohol, celluloses, polyvinylpyridine, polyvinylpyrrolidone, phenol resins, polyurethane, casein, silane coupling agents, organic zirconium compounds, etc.

Then, the invention is explained with reference to the following examples.

EXAMPLE 1

In a sand grind mill using glass beads of 1 mm in diameter were charged 87 parts by weight of granular trigonal system selenium (average particle size: about 3 μm) and a solution formed by dissolving 13 parts by weight of a vinyl chloride-vinyl acetate copolymer (Solution Vinyl VMCH, trade name, made by Union Carbide Co.) in 200 parts by weight of n-butyl acetate, and the mixture was dispersed for 40 hours.

Each of the mixture before the dispersion treatment and the coating composition after the dispersion treatment was coated on a glass plate and dried to form a coated layer having a thickness of 1.0 μm and spectral absorbances at 500 n.m. ($d^o_{500}$ and $d^o_{500}$) and the spectral absorbances at 700 n.m. ($d^o_{700}$ and $d^o_{700}$) were measured by means of a spectrophotometer. The results obtained are shown in Table 1.

A coating composition composed of the following components was coated on an aluminum pipe (outside diameter 84 mm, length 360 mm) as an electrically conductive support by a dip coating method and dried by heating to 150° C. for 5 minutes, whereby a subbing layer of 0.1 μm in thickness was formed.

| | |
|---|---|
| Organic zirconium compound (Orgatics ZC540, trade name, made by Matsumoto seiyaku K.K.) | 10 g |
| Silane coupling material (A1110, trade name, made by Nippon UniCar K.K.) | 1.1 g |

-continued

| | |
|---|---|
| Methanol | 50 g |
| n-Butanol | 20 g |

Then, 30 parts by weight of the aforesaid coating composition for forming a charge generating layer was diluted with 57 parts by weight of n-butyl acetate to provide a coating composition for dipping. The aluminum pipe having the subbing layer was dipped in the aforesaid coating composition contained in a dip coating bath, pulled up at a rate of 100 mm/min., and dried by heating to 100° C. for 5 minutes to form a charge generating layer of about 0.1 μm in thickness.

Then, 1 part by weight of the charge transport material shown by following formula (I') and 1 part by weight of the polycarbonate resin shown by aforesaid formula (II) were dissolved in 8 parts by weight of monochlorobenzene to prepared a dip coating composition.

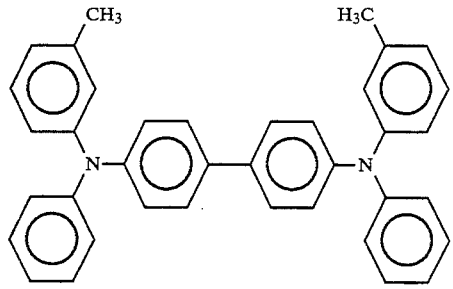

(I')

The aluminum pipe having the charge generating layer was dipped in the aforesaid dip coating composition, pulled up at a rate of 90 mm/min., and dried by heating to 100° C. for one hour to form a charge transport layer of about 20 μm in thickness. Thus, an electrophotographic photoreceptor having the photosensitive layer composed of three layers was prepared.

The electrophotographic photoreceptor was mounted on a copying machine (FX5030 modified machine, made by Fuji Xerox Co., Ltd.), the charging device and the high-voltage electric source were controlled such that the dark potential VD became −800 V, and also the light quantity of the light source was controlled such that the bright potential VL became −150 V. Thereafter, a durability test of 100,000 copies was carried out and the changes of the dark potential VD and the bright potential VL were measured. Also, the image quality was evaluated at the same time.

EXAMPLE 2

By following the same procedure as Example 1 except that the bisazo pigment shown by the following structural formula (average particle size: 1.3 μm) was subjected to dispersion treatment together with the binder resin and the organic solvent by the same dispersing machine as in Example 1 for 5 hours.

Bisazo pigment:

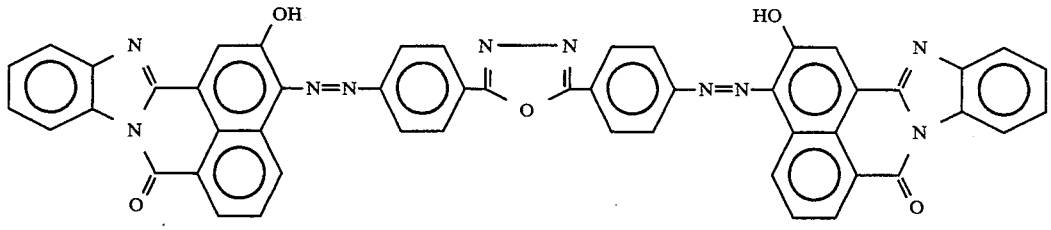

Then, the same evaluations as in Example 1 were performed.

EXAMPLE 3

The same dispersion treatment as in Example 1 was followed using 60 parts by weight of the bisazo pigment used in Example 2, 40 parts by weight of a polyvinylbutyral resin as the binder resin, and cyclohexanone as the solvent. In this case, however, the dispersion treatment time was 3 hours. Then, an electrophotographic photoreceptor was prepared by the same manner as in Example 1 and the same evaluations as in Example 1 were performed.

EXAMPLE 4

The same dispersion treatment as in Example 1 was followed using 87 parts by weight of granular trigonal system selenium, 13 parts by weight of a polyvinylbutyral resin as the binder resin, and 3-pentanol as the solvent. In this case, however, the dispersion treatment time was 10 hours. Then, an electrophotographic photoreceptor was prepared by the same manner as in Example 1 and the same evaluations as in Example 1 were performed.

COMPARISON EXAMPLE 1

By following the same procedure as Example 1 except that the coating composition for the charge generating layer was subjected to the dispersion treatment for 5 hours, an electrophotographic photoreceptor was prepared and the same evaluations were performed.

COMPARISON EXAMPLE 2

By following the same procedure as Example 2 except that the coating composition for the charge generating layer was prepared by dispersing the mixture for one hour, an electrophotographic photoreceptor was prepared and the same evaluations were performed.

COMPARISON EXAMPLE 3

By following the same procedure as Example 1 except that tetrahydrofuran was used as the solvent for the dispersion treatment, an electrophotographic photoreceptor was prepared and the same evaluations were performed.

COMPARISON EXAMPLE 4

By following the same procedure as Example 1 except that 93 parts by weight of granular trigonal system selenium and 7 parts by weight of a vinyl chloride-vinyl acetate (Solution, Vinyl VMCH) were used, an electrophotographic photoreceptor was prepared and the same evaluations were performed.

COMPARISON EXAMPLE 5

By following the same procedure as Example 1 except that cellulose acetate butyrate was used in place of the vinyl chloride-vinyl acetate copolymer, an electrophotographic photoreceptor was prepared and the same evaluations were performed.

The various conditions and the evaluation results in aforesaid Examples 1 to 4 and Comparison Examples 1 to 5 are summarized in Table 1 below.

TABLE 1

| | Charge Generating Material | Binder Resin | Ratio of Charge Generating Material To Resin {wt/wt} | Solvent | Dispersing Time {hr} | Dispersivity: Before Dispersion $d^{\circ}_{500}/d^{\circ}_{700}$ | Dispersivity: After Dispersion $d_{500}/d_{700}$ | $d_{500}/d_{700}$ / $d^{\circ}_{500}/d^{\circ}_{700}$ | Potential after Copying 100,000 Copies: VD {—Y} | Potential after Copying 100,000 Copies: VL {—V} | Image Quality After Copying 100,000 Copies | Initial Coating State |
|---|---|---|---|---|---|---|---|---|---|---|---|---|
| Example 1 | Trigonal System Selenium | Vinyl Chloride-Vinyl Acetate Copolymer | 87:13 | n-Butyl Acetate | 40 | 0.7 | 4.2 | 5.0 | 780 | 180 | Clear Copy Without Image Defect of White Pepper or Black Pepper | Uniform and Smooth Coated Layer having no Coating Defect |
| Example 2 | Bisazo Pigment | Vinyl Chloride-Vinyl Acetate Copolymer | 87:13 | n-Butyl Acetate | 5 | 1.1 | 2.8 | 2.5 | 750 | 200 | Clear Copy Without Image Defect of White Pepper or Black Pepper | Uniform and Smooth Coated Layer having no Coating Defect |
| Example 3 | Bisazo Pigment | Polyvinyl-butyral Resin | 60:40 | Cyclo-hexanone | 3 | 1.1 | 2.9 | 2.6 | 780 | 230 | Clear Copy Without Image Defect of White Pepper or Black Pepper | Uniform and Smooth Coated Layer having no Coating Defect |
| Example 4 | Trigonal System Selenium | Polyvinyl-butyral Resin | 87:13 | 3-Pentanol | 10 | 0.7 | 1.7 | 2.4 | 740 | 210 | Clear Copy Without Image Defect of White Pepper or Black Pepper | Uniform and Smooth Coated Layer having no Coating Defect |
| Comp. Example 1 | Trigonal System Selenium | Vinyl Chloride-Vinyl Acetate Copolymer | 87:13 | n-Butyl Acetate | 5 | 0.7 | 1.0 | 1.4 | 630 | 390 | Dense Overall Fog on Back-ground portion | Ununiform Coated Layer having Fine Light and Shade Pattern of Roughened Feeling |
| Comp. Example 2 | Bisazo Pigment | Vinyl Chloride-Vinyl Acetate Copolymer | 87:13 | n-Butyl Acetate | 1 | 1.1 | 1.7 | 1.5 | 950 | 505 | Dense Overall Fog On Back-ground portion | Ununiform Coated Layer having Fine Aggregates on the Whole Surface |
| Comp. Example 3 | Trigonal System Selenium | Vinyl Chloride-Vinyl Acetate Copolymer | 87:13 | Tetra-hydro-furan | 40 | 0.7 | 1.1 | 1.6 | 810 | 410 | Dense Overall Fog On Back-ground portion | Ununiform Coated Layer having Fine Aggregates on the Whole Surface |
| Comp. Example | Trigonal System | Vinyl Chloride- | 93:7 | n-Butyl Acetate | 40 | 0.7 | 1.2 | 1.7 | 710 | 370 | Dense Overall Fog | Ununiform Coated Layer |

TABLE 1-continued

| | Charge Generating Material | Binder Resin | Ratio of Charge Generating Material To Resin {wt/wt} | Solvent | Dispersing Time {hr} | Dispersivity: Before Dispersion $d^{\circ}_{500}/d^{\circ}_{700}$ | Dispersivity: After Dispersion $d_{500}/d_{700}$ | $d_{500}/d_{700}$ $d^{\circ}_{500}/d^{\circ}_{700}$ | Potential after Copying 100,000 Copies: VD {—Y} | Potential after Copying 100,000 Copies: VL {—V} | Image Quality After Copying 100,000 Copies | Initial Coating State |
|---|---|---|---|---|---|---|---|---|---|---|---|---|
| 4 | Selenium | Vinyl Acetate Copolymer | | | | | | | | | On Background portion | having Fine Aggregates on the Whole Surface |
| Comp. Example 5 | Trigonal System Selenium | Cellulose Acetate Butyrate | 87:13 | Cyclohexanone | 40 | 0.7 | 0.9 | 1.3 | 620 | 380 | Dense Overall Fog On Background portion | Ununiform Coated Layer having Fine Aggregates on the Whole Surface |

As described above, according to this invention, the dispersibility and the dispersion stability of the coating composition for the photosensitive layer and hence in the electrophotographic photoreceptor of this invention formed by using the coating composition, the dispersibility of the photosensitive layer is improved and the electrophotographic photoreceptor of this invention has a good coated surface property without causing roughening of image quality, has a high sensitivity, and shows a high repeatedly using stability.

While the invention has been described in detail and with reference to specific embodiments thereof, it will be apparent to one skilled in the art that various changes and modifications can be made therein without departing from the spirit and scope thereof.

What is claimed is:

1. A method for determining a termination time of the step of dispersing a coating composition for a photosensitive layer, containing a binder resin, a powdery charge generating material and a solvent, which comprises:

(i) providing a nondispersed coating (I) on a substrate by coating the coating composition, following by drying, (ii) providing coating (II) on a substrate by dispersing the coating composition using a dispersion medium to fine the powdery charge generating material, followed by drying, (iii) measuring absorbances of coating (I) at two wavelengths within a short wavelength region and a long wavelength region, respectively, of the spectral absorption wavelength of the charge generating material, (iv) measuring absorbances of coating (II) at the two wavelengths within the short wavelength region and the long wavelength region, respectively, and (v) calculating spectral absorbance ratios of coatings (I) and (II), respectively, from the following equation:

$$\text{Spectral absorbance ratio} = \frac{\text{Absorbance at a wave length with the short wavelength region}}{\text{Absorbance at a wavelength within the long wavelength region}}$$

wherein said dispersing of the coating composition is terminated when the ratio of the spectral absorbance ratio of coating (II) to that of coating (I) exceed a predetermined value.

2. The method of claim 1, wherein said coatings (I) and (II) are formed in thicknesses of 0.1 to 5.0 μm on a light-transmitting substrate and transmission absorbances of said coatings (I) and (II) are measured.

3. The method of claim 1, wherein said charge generating material is a material having a sensitivity in at least almost the whole visible light region.

4. The method of claim 3, wherein the charge generating material also has a sensitivity in an infrared region.

5. The method of claim 1, wherein said short wavelength region is from 400 n.m. to 500 n.m. and said long wavelength region is from 650 n.m. to 750 n.m.

6. The method of claim 1, wherein the powdery charge generating material contained in said coating composition for coating (I) has an average paricle size of from 0.5 to 500 μm.

7. The method of claim 6, wherein said average particle size is from 1 to 50 μm.

8. The method of claim 1, wherein said photosensitive layer is a charge generating layer.

9. An electrophotographic photoreceptor having on an electrically conductive support a photosensitive layer formed by coating a coating composition which contains a binder resin, trigonal system selenium and a solvent and which has been dispersed with a dispersion medium, wherein the spectral absorbance ratio given by the following equation of the coated layer is at least twice the spectral absorbance ratio of a coated layer of the coating composition which is not subjected to the dispersing treatment;

$$\text{Spectral absorbance ratio} = \frac{\text{Absorbance at 500 n.m.}}{\text{Absorbance at 700 n.m.}}.$$

* * * * *

UNITED STATES PATENT AND TRADEMARK OFFICE

CERTIFICATE OF CORRECTION

PATENT NO. : 5, 403,688
DATED : April 4, 1995
INVENTOR(S) : Seiji Ashiva et al.

It is certified that error appears in the above-indentified patent and that said Letters Patent is hereby corrected as shown below:

Abstract, Front Page, Line 7, "following" should read --followed--.

Abstract, In Equation "wave length" (First Occurrence) to --wavelength--.

Claim 1, Column 17, Line 22 (From top of column - disregard line markers) "following" should read --followed--.

Claim 1, Column 18, Line 1 "wave length" should read --wavelength--.

Claim 6, Column 18, Line 25 "paricle" should read --particle--.

Signed and Sealed this
Third Day of October, 1995

Bruce Lehman

*Attest:*

BRUCE LEHMAN

*Attesting Officer*

*Commissioner of Patents and Trademarks*